US006409119B1

(12) United States Patent
Yabuno

(10) Patent No.: US 6,409,119 B1
(45) Date of Patent: Jun. 25, 2002

(54) WINDING CORE FIXING DEVICE

(75) Inventor: Mitoshi Yabuno, Kyoto (JP)

(73) Assignee: Nishimura Seisakusho Co., Ltd., Kyoto (JP)

( * ) Notice: Subject to any disclaimer, the term of this patent is extended or adjusted under 35 U.S.C. 154(b) by 0 days.

(21) Appl. No.: 09/856,595

(22) PCT Filed: May 12, 2000

(86) PCT No.: PCT/JP00/03088

§ 371 (c)(1),
(2), (4) Date: May 23, 2001

(87) PCT Pub. No.: WO00/69763

PCT Pub. Date: Nov. 23, 2000

(30) Foreign Application Priority Data

May 17, 1999 (JP) ..... 11-003337

(51) Int. Cl.[7] ..... B65H 75/26
(52) U.S. Cl. ..... 242/571.6
(58) Field of Search ..... 242/571.6, 571.7, 242/574

(56) References Cited

U.S. PATENT DOCUMENTS 4,175,712 A * 11/1979 Schippers et al.
5,683,058 A * 11/1997 Schwarzet et al.

FOREIGN PATENT DOCUMENTS

JP 2-13545 * 2/1990
JP 10265103 A * 6/1998
JP 10250886 A * 9/1998
JP 11079482 A * 3/1999

* cited by examiner

*Primary Examiner*—William A. Rivera
(74) *Attorney, Agent, or Firm*—Kirschstein, et al.

(57) ABSTRACT

A winding core fixing device of simple structure, wherein a plurality of pivot shafts (7) are swung about pins (6) thereof according to the rotation of a winding shaft (3), and one rotating body among rotating bodies (8) at both ends of the pivot shaft is pressed against the inner peripheral surface of a winding core (1), whereby the winding core is fixed.

1 Claim, 2 Drawing Sheets

WINDING CORE FIXING DEVICE

TECHNICAL FIELD

The invention relates to a winding apparatus for winding a web material such as paper or plastic film on a winding core, especially to a winding core fixing apparatus in the winding apparatus.

BACKGROUND

In a slitter for slitting a web material such as paper or plastic film, it is intended to wind the slitted web materials on winding cores. For example, in the slitter disclosed in Japanese Patent Publication No. 30621 of 1985, a plurality of cylinder blocks are provided on a winding shaft, pistons being inserted into the cylinder blocks. A plurality of slides are provided on the winding shaft, tapered surfaces being formed on the slides, a plurality of tips being spaced angularly from each other around the slides. The slides are pushed by the cylinder blocks and the pistons so that the tips can be pressed against the inner surfaces of the winding cores to thereby fix the winding cores. The winding shaft is rotationally driven by a drive motor to wind the web materials on the winding cores.

However, the apparatus is problematic in that it is complicated by the arrangement of the slides, the tips and the like involving a machining accuracy, to be high in cost. In addition, the wound products are required to be moved axially of the winding shaft and drawn out of the winding shaft after winding, with a work troubled by each of the wound products having a large weight.

It is therefore an object of the invention to provide a winding core fixing apparatus which is simple in structure.

It is other object of the invention to provide the apparatus in which the wound product can be drawn out without difficulty.

DISCLOSURE OF THE INVENTION

According to the invention, the apparatus comprises a plurality of pins extending axially of a winding shaft and supported to be spaced angularly from each other around the winding shaft. The apparatus further comprises a plurality of axles extending in a direction of rotation of the winding shaft, supported by the pins for swingingly movement and having opposite ends which are disposed on the opposite sides of the pins. A plurality of rotatable bodies are provided on the opposite ends of the axles. Accordingly, one of the rotatable bodies of the opposite ends of each of the axles is pressed against the inner surface of a winding core to thereby fix the winding core in accordance with the rotation of the winding shaft.

THE BEST MODE TO BE CARRY OUT THE INVENTION

Figure 1:
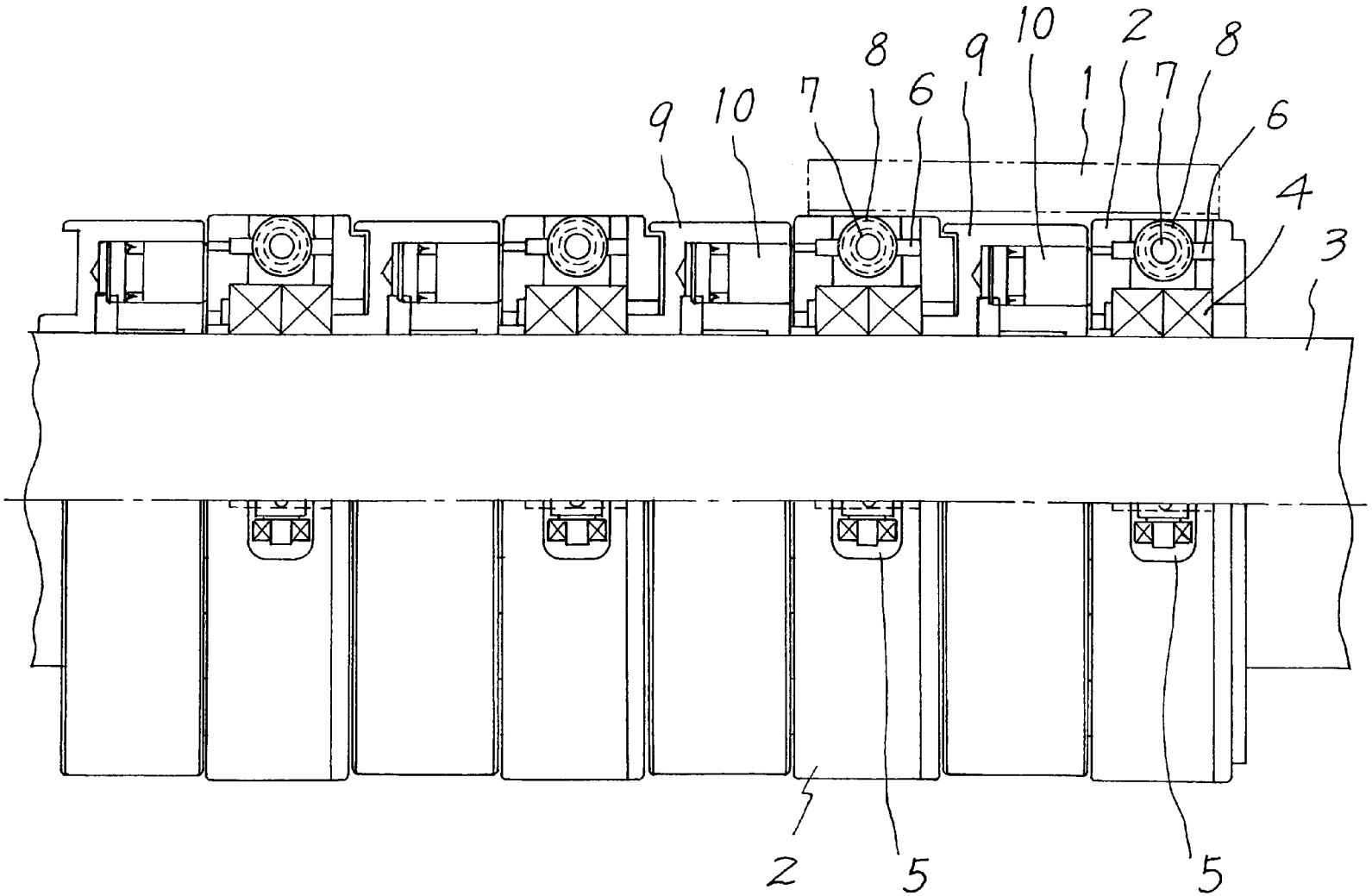
FIG. 1 is a longitudinally sectional view of the embodiment of the invention.

Referring now to the drawings, FIG. 1 illustrates a winding core fixing apparatus in a slitter for fixing a plurality of winding cores 1. The apparatus includes a plurality of holders 2 which are ring-shaped and provided on a winding shaft 3 to be spaced axially from each other and supported by bearings 4 for rotation.

Figure 2:
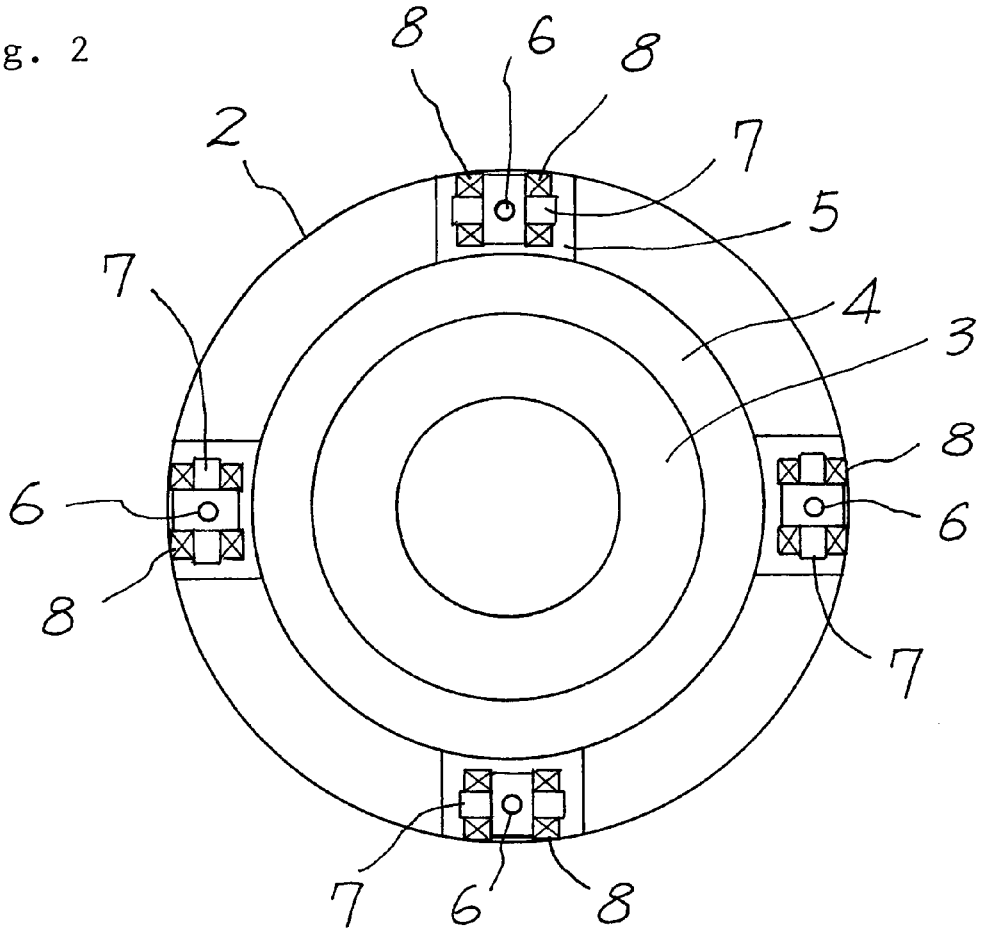
FIG. 2 is a cross sectional view of the apparatus of Fig. 1.
Figure 3:
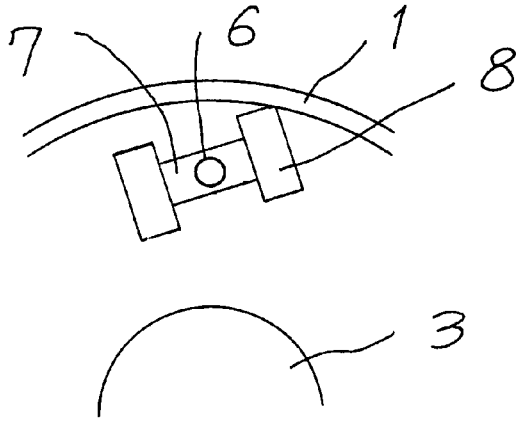
FIG. 3 is an explanatory view illustrating the relative arrangement between the rotatable bodies and the winding core of Fig. 2.

A plurality of grooves 5 are formed in the outer surface of each of the holders 2, a plurality of pins 6 being spaced angularly from each other around the winding shaft 3 and received in the grooves 5, as shown in FIG. 2. The pins 6 extend axially of the winding shaft 3 and have opposite ends which are secured and supported by the holders 2. The pins 6 are therefore supported by the winding shaft 3, the bearings 4 and the holders 6. In addition, a plurality of axles 7 are received in the grooves 5 to extend in a direction of rotation of the winding shaft 3. The axles 7 are supported by the pins 6 for swingingly movement to have opposite ends which are disposed on the opposite sides of the pins 6. A plurality of rotatable bodies 8 are received in the grooves 5, the rotatable bodies 8 comprising rollers which are provided and mounted on the opposite ends of the axles 7 for rotation. The rotatable bodies may comprise gears mounted on the opposite ends of the axles 7 for rotation.

The apparatus further includes a plurality of cylinder blocks 9 which are ring-shaped, interposed between the holders 2 and fitted and fixed on the outer surface of the winding shaft 3, as in the case of Japanese Patent Publication No. 30621 of 1985. Pistons 10 are inserted into axial bores formed in each of the cylinder blocks 9, as also disclosed in the Japanese Patent Publication. Fluid such as air is fed into the cylinder blocks 9 so that the pistons 10 can be engaged with and pressed against the end surfaces of the holders 2.

In the apparatus, the winding cores are disposed around and spaced axially of the winding shaft 3 to have positions corresponding to adjacent pairs of the holders 2. The winding shaft 3 is then rotationally driven by drive motor so that a torque is transmitted to the cylinder blocks 9 and the pistons 10. The holders 2 are rotated with the torque transmitted by frictions between the pistons 10 and the holders 2. The axles 7 are therefore swingingly moved about the pins 6 so that one of the rotational bodies 8 of the opposite ends of each of the axles 7 can be pressed against the inner surface of the winding core 1 to bite thereinto in accordance with the rotation of the winding shaft 3.

For example, the axles 7 are swingingly moved counterclockwise in FIG. 2 about the pins 6 when the winding shaft 3 and the holders 2 are rotated clockwise in FIG. 2. The rotational body 8 of the right end of each of the axles 7 is therefore pressed against the inner surface of the winding core 1 to bite therein. This can lock and fix the winding core 1. On the contrary, the axles 7 are swingingly moved clockwise in FIG. 2 about the pins 6 when the winding shaft 3 and the holders 2 are rotated counterclockwise in FIG. 2. The rotational body 8 of the left end of each of the axles 7 is therefore pressed against the inner surface of the winding core 1 to bite therein. This can lock and fix the winding core 1.

Accordingly, the winding cores 1 can be rotated independently of each other with the torque transmitted by the frictions between the pistons 10 and the holders 2 to wind the web materials on the winding cores 1 after slitting the web material such as paper or plastic film.

The winding shaft 3 and the holders 2 are rotated reversely and slightly after winding the web materials. The axles 7 are therefore swingingly moved reversely about the pins 6 so that the rotational bodies 8 can be disengaged from the winding cores 1 to unlock them. The wound products are then supported on the rotational bodies 8 of the axles 7. The wound products may be rotated reversely to unlock them.

Accordingly, the wound products can be moved axially of the winding shaft 3 and drawn out of the winding shaft 3. The rotational bodies 8 are rotated about the axles 7 in the holders 2 in response to the movement of the wound products when moved axially of the winding shaft 3, to thereby guide the wound products and minimize the resistances thereof. The wound products can therefore be moved and drawn out without difficulty even if each of them has a large weight.

As described above, according to the invention, axles 7 are swingingly moved about the pins 6 so that one of the rotatable bodies 8 of the opposite ends of each of the axles 7 can be pressed against the inner surface of the winding core 1 to fix the winding core 1 in accordance with the rotation of the winding shaft 3. The apparatus is simple in structure to be low in cost. In addition, the rotatable bodies 8 guide the wound products when moved axially of the winding shaft 3 and drawn out of the winding shaft 3 so that the wound products can be moved and drawn out without difficulty to achieve the desired end.

What is claimed is:

1. The winding core fixing apparatus comprising:

a plurality of pins extending axially of a winding shaft and supported to be spaced angularly from each other around said winding shaft;

a plurality of axles extending in a direction of rotation of said winding shaft, supported by said pins for swingingly movement and having opposite ends which are disposed on the opposite sides of said pins; and a plurality of rotatable bodies provided on the opposite ends of said axles, one of said rotatable bodies of said opposite ends of each of said axles being pressed against the inner surface of a winding core to thereby fix said winding core in accordance with the rotation of said winding shaft.

* * * * *